US008596696B2

(12) United States Patent
Cumbo et al.

(10) Patent No.: US 8,596,696 B2
(45) Date of Patent: Dec. 3, 2013

(54) VEHICULAR LATCH WITH SINGLE NOTCH RATCHET

(75) Inventors: Francesco Cumbo, Pisa (IT); Marco Taurasi, Livorno (IT)

(73) Assignee: Magna Closures S.p.A., Collesalvetti (IT)

( * ) Notice: Subject to any disclaimer, the term of this patent is extended or adjusted under 35 U.S.C. 154(b) by 318 days.

(21) Appl. No.: 13/033,953

(22) Filed: Feb. 24, 2011

(65) Prior Publication Data

US 2011/0204660 A1 Aug. 25, 2011

Related U.S. Application Data

(60) Provisional application No. 61/307,597, filed on Feb. 24, 2010.

(51) Int. Cl.
*E05C 3/06* (2006.01)
*E05C 3/16* (2006.01)

(52) U.S. Cl.
USPC ..... 292/216; 292/201; 292/217

(58) Field of Classification Search
USPC ..... 292/201, 216
See application file for complete search history.

(56) References Cited

U.S. PATENT DOCUMENTS

| | | | | | |
|---|---|---|---|---|---|
| 2,881,021 | A * | 4/1959 | Jacobson | 292/229 |
| 3,347,584 | A * | 10/1967 | Johnstone | 292/198 |
| 3,386,761 | A * | 6/1968 | Johnstone et al. | 292/201 |
| 3,905,627 | A * | 9/1975 | Fujita | 292/216 |
| 4,783,102 | A * | 11/1988 | Bernard | 292/216 |
| 4,978,153 | A * | 12/1990 | Hirsch et al. | 292/201 |
| 5,288,115 | A * | 2/1994 | Inoue et al. | 292/201 |
| 7,959,205 | B2 * | 6/2011 | Paing et al. | 296/65.03 |
| 8,235,428 | B2 * | 8/2012 | Hunt et al. | 292/216 |
| 8,398,128 | B2 * | 3/2013 | Arabia et al. | 292/216 |
| 2010/0052336 | A1 * | 3/2010 | Bendel et al. | 292/196 |
| 2011/0127780 | A1 * | 6/2011 | Barth et al. | 292/213 |

* cited by examiner

*Primary Examiner* — Carlos Lugo
(74) *Attorney, Agent, or Firm* — Dickinson Wright

(57) ABSTRACT

A double pawl latch having a ratchet, a primary pawl interacting with the ratchet, a secondary pawl interacting with the primary pawl, and a pawl lever interacting with the secondary pawl. The ratchet has a single notch which interacts with the primary pawl to keep the ratchet in a full striker capture position. If the primary pawl is unintentionally released, the pawl lever includes a backup pawl that interacts with the ratchet single notch, keeping the ratchet in an intermediate striker retaining position where the latch is still closed. The pawl lever initiates opening of the latch by withdrawing the backup pawl from the path of the ratchet and by actuating the secondary pawl. Momentum from the seal force thereafter drives the primary and secondary pawls open, but if the momentum is insufficient the pawl lever can sequentially also open the main pawl after actuating the secondary pawl.

15 Claims, 4 Drawing Sheets

VEHICULAR LATCH WITH SINGLE NOTCH RATCHET

CROSS-REFERENCE TO RELATED APPLICATIONS

This application claims the benefit of and priority to U.S. Provisional Application No. 61/307,597 filed Feb. 29, 2010. The entire disclosure of the above application is incorporated herein by reference.

FIELD OF THE INVENTION

The invention generally relates to the art of vehicular latches and more specifically vehicular latches that utilize double pawl arrangements.

BACKGROUND OF THE INVENTION

Double pawl arrangements are known in the latching art. The double pawl arrangement may utilize a first pawl and ratchet set connected to a second pawl and ratchet set. The connection may be configured such that only a portion of the forces experienced by the first pawl and ratchet set are applied to the second pawl and ratchet set, thus requiring only a relatively low effort to release the latch. While this is desirable, it also leads to the problem that an unbalanced force may unintentionally release the latch in unintended circumstances such as a crash situation. It would be desirable to preclude such events.

Further, in some jurisdictions regulations require side door latches to provide fully closed and intermediate closed positions. This is conventionally achieved by designing the ratchet to have two notches on the ratchet profile that are engaged alternatively by a pawl that keeps the latch at a fully closed or partially closed position. The conventional approach limits the freedom in minimizing the dimensions and the weight of the ratchet and will cause also design complexity in double pawl latches. A more elegant solution is sought.

SUMMARY OF THE INVENTION

One broad aspect of the invention relates to a vehicle latch having a ratchet with a single notch that is utilized to hold the ratchet in either a full striker capture position or an intermediate partial striker retaining position where the latch still remains closed.

According to this aspect of the invention, a vehicle latch is provided including a ratchet having a single notch, a primary pawl having a shoulder for engaging the ratchet notch, and a pawl lever having a backup pawl for engaging the ratchet notch. The ratchet is movable between a striker release position, wherein the ratchet is positioned to receive a striker, and a full striker capture position, wherein the ratchet is positioned to retain the striker, the ratchet preferably being biased towards the striker release position. The primary pawl is movable between a ratchet holding position, wherein the shoulder is positioned to engage the notch in order to keep the ratchet in the full striker capture position, and a ratchet release position, wherein the primary pawl permits the movement of the ratchet out of the full striker capture position, the primary pawl preferably being biased towards the ratchet holding position. The pawl lever is movable between an initial position, in which the backup pawl is situated in the path of the ratchet notch so as to hold the ratchet in an intermediate striker retaining position in the event the primary pawl unintentionally moves out of the ratchet holding position, and an actuated position, in which the pawl lever initiates the opening of the latch and the backup pawl is withdrawn from the path of ratchet notch, the pawl lever preferably being biased towards the initial position.

Another aspect of the invention relates to the arrangement of a double pawl latch. According to this aspect of the invention a latch is provided having a housing, a ratchet, a primary pawl, a secondary pawl and a pawl release lever. The ratchet is pivotally mounted in the housing for rotation about a first axis. The ratchet is movable between a striker release position, wherein the ratchet is positioned to receive a striker, and a full striker capture position, wherein the ratchet is positioned to retain the striker. The ratchet is preferably biased towards the striker release position. The primary pawl is pivotally mounted in the housing for rotation about a second axis. The primary pawl is movable between a ratchet holding position, wherein the primary pawl keeps the ratchet in the full striker capture position, and a ratchet release position, wherein the primary pawl permits the movement of the ratchet out of the full striker capture position. The primary pawl is preferably biased towards the ratchet holding position. The secondary pawl is pivotally mounted in the housing for rotation about a third axis. The secondary pawl is movable between a primary pawl blocking position, wherein the secondary pawl inhibits movement of the primary pawl from its ratchet holding position, and a primary pawl non-blocking position, wherein the secondary pawl allows movement of the primary pawl into its ratchet release position. The secondary pawl is preferably biased to the primary pawl blocking position. The pawl lever is pivotally mounted in the housing for rotation about a fourth axis. The pawl lever has a first portion for engaging the secondary pawl and a second portion for engaging the primary pawl. The pawl lever is movable between an initial position in which the pawl lever does not engage the secondary pawl and primary pawl, and an actuated position, in which the pawl lever actuates at least the secondary pawl to move the secondary pawl into its primary pawl non-blocking position. The pawl lever is preferably biased towards the initial position.

Another aspect of the invention relates to a low effort quick release of the foregoing latch. According to this aspect, when the latch is closed, the ratchet is in its full striker capture position, the primary pawl is in its ratchet holding position, and the secondary pawl is in its primary pawl blocking position. These components are configured such that a seal force applied to the ratchet is translated to an opening force applied by the primary pawl against the secondary pawl in a direction substantially crossing the third rotational axis. In this manner, there is no moment on the secondary pawl when the latch is closed.

However, actuation of the pawl lever causes movement of the secondary pawl so as to change the direction of the opening force away from the third rotational axis, enabling momentum from the ratchet to drive the primary pawl into the ratchet release position.

And in the event the aforesaid momentum is insufficient to move the primary pawl into its ratchet release position, the pawl lever is configured to sequentially actuate the primary pawl via the second portion after the first portion of the pawl lever has actuated the secondary pawl into the primary pawl non-blocking position.

BRIEF DESCRIPTION OF THE DRAWINGS

The foregoing and other aspects of the invention will be more readily appreciated having reference to the drawings, wherein.

DETAILED DESCRIPTION OF PREFERRED EMBODIMENTS

Figure 1:
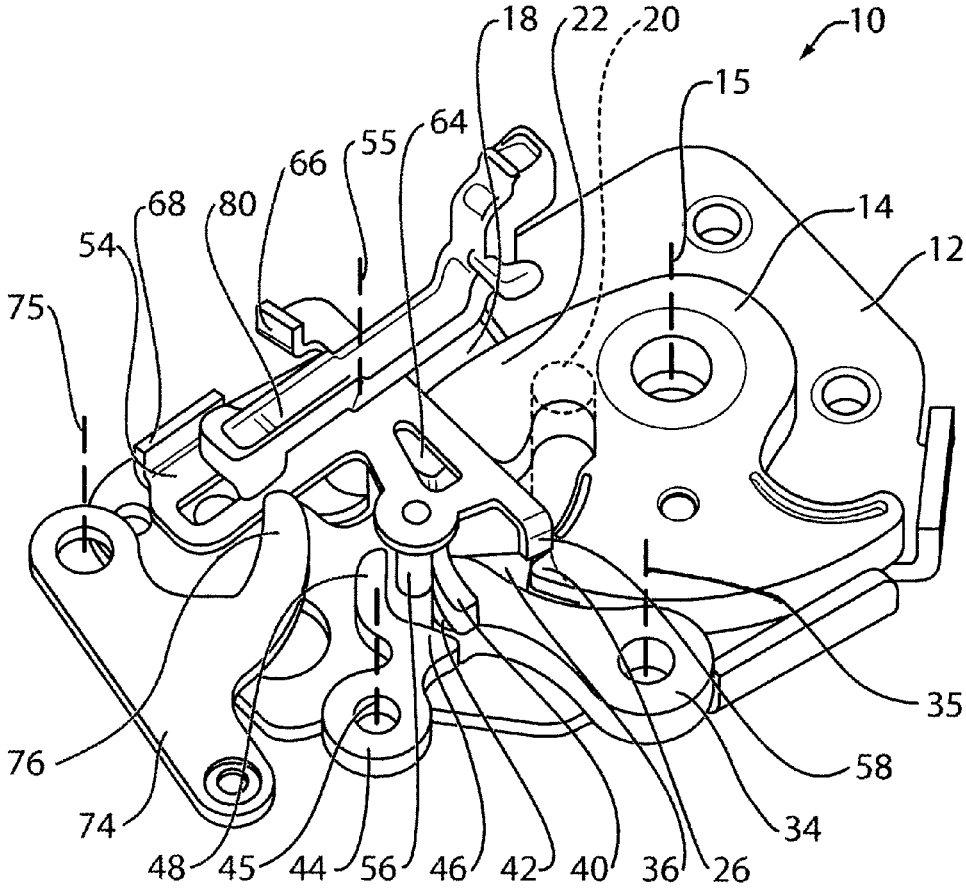
FIG. 1 is a perspective view of a portion of a latch with cover partially removed from view.
Figure 2A:
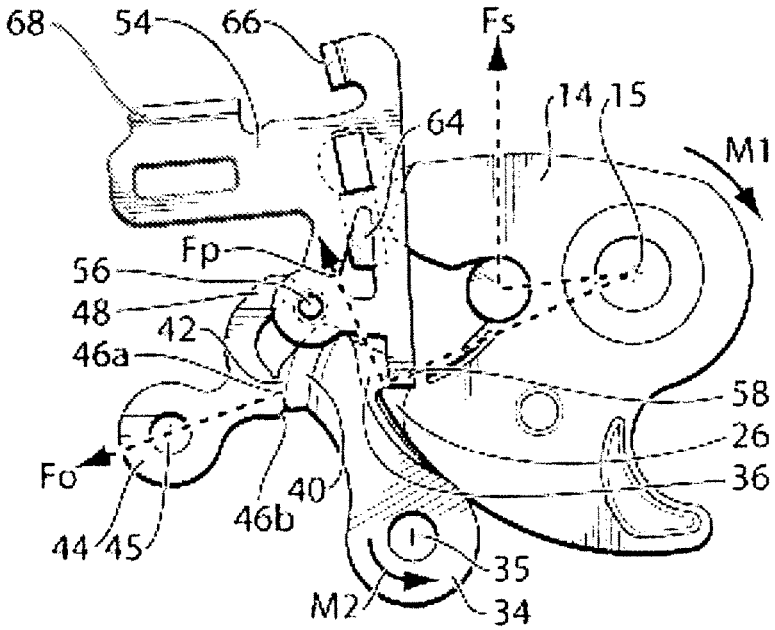
FIG. 2A is a plan view of a portion of the latch shown in FIG. 1 in a full closed position.
Figure 2B:
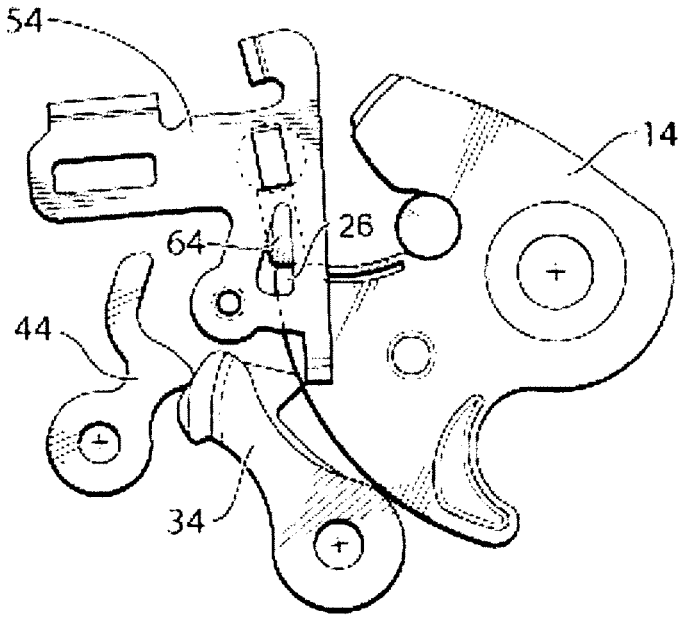
FIG. 2B is a plan view of a portion of the latch shown in FIG. 1 in an intermediate or partially closed position.

FIG. 1 is a perspective view of a latch 10 in a fully closed position. The latch 10 has a ratchet 14 that is pivotally mounted within a frame or housing 12 (only partially shown) for rotation about a rotational axis 15. The housing 12 features a fish-mouth or slot 18 in which a striker 20 may travel, and the ratchet 14 features a hook 22 for retaining the striker 20 in the slot 18. The ratchet 14 pivots between a full striker capture position wherein the striker 20 is captured by the hook 22 of the ratchet 14, as shown in FIG. 1, and a striker release position wherein the striker 20 is not trapped by the hook 22 and is free to move out of the slot 18. The ratchet 14 can also move to an intermediate striker retaining position as shown in FIG. 2B and discussed in greater detail below. (In the orientation of FIG. 1, the ratchet 14 will rotate clockwise to move into the intermediate striker retaining position and/or into the striker release position.)

The ratchet 14 is biased to the striker release position. This may be carried out via a biasing spring (not shown) or by other forces applied on the latch.

The ratchet 14 also has a single shoulder or notch 26 for checking the opening urge of the ratchet 14. Notably, this notch 26 is utilized to check the ratchet 14 in the full striker capture position and in the intermediate striker retaining portion, as discussed in greater detail below.

A primary pawl 34 is pivotally mounted in the housing 12 for rotation about another rotational axis 35. The primary pawl 34 moves between a ratchet holding position where the primary pawl 34 checks the opening movement of the ratchet 14 from its full striker capture position, as shown in FIG. 1, and a ratchet release position (FIG. 3B) where the primary pawl 34 does not interfere with the opening movement of the ratchet 14 into its intermediate striker retaining position and/or its striker release position. (In the orientation of FIG. 1, the primary pawl 34 will rotate counterclockwise to leave the ratchet holding position.)

The primary pawl 34 features a hook shoulder 36 for engaging the ratchet notch 26 and is preferably biased to the ratchet holding position via a spring (not shown) or other biasing member. Opposite the hook shoulder 36, the primary pawl 34 includes a ridge 40 and a cam profile 42, the purpose of which is discussed below.

A secondary pawl 44 is pivotally mounted in the housing 12 for rotation about yet another rotational axis 45. The secondary pawl 44 moves between a primary pawl blocking position at one end of its travel where the secondary pawl 44 inhibits the opening movement of the primary pawl 34 from its ratchet holding position, as shown in FIG. 1, and a primary pawl non-blocking position (FIG. 3A or FIG. 3B) where the secondary pawl 44 allows the opening movement of the primary pawl 34 into its ratchet release position. (In the orientation of FIG. 1 the secondary pawl 34 will rotate counterclockwise to leave the primary pawl blocking position.)

The secondary pawl 44 features a cam follower profile 46 that engages the primary pawl cam profile 42. The secondary pawl 44 is preferably biased to the primary pawl blocking position via a spring or other biasing member (not shown). The secondary pawl 44 also includes a lever arm 48, the purpose of which is discussed below.

A pawl lever 54 is pivotally mounted in the housing 12 for rotation about a rotational axis 55. The pawl lever 54 interacts with at least the secondary pawl 44, and as discussed in greater detail below, may interact with the primary pawl 34 and ratchet 14.

More particularly, the pawl lever 54 has a depending post 56 that interacts with the secondary pawl lever arm 48 in order to move the secondary pawl 44 out of its primary pawl blocking position. The pawl lever 54 also includes a depending finger 58 that may interact with the ridge 40 of the primary pawl 34. (Note that finger 58 does not contact or otherwise engage the primary pawl hook shoulder 36—only ridge 40 which is set back from shoulder 36.) Additionally, a backup pawl 64 is mounted to the pawl lever 54 via a rigid connection and rotates in conjunction therewith. The backup pawl 64 may interact with the hook shoulder 36 of the primary pawl 34 under certain conditions as discussed below.

Figure 3A:
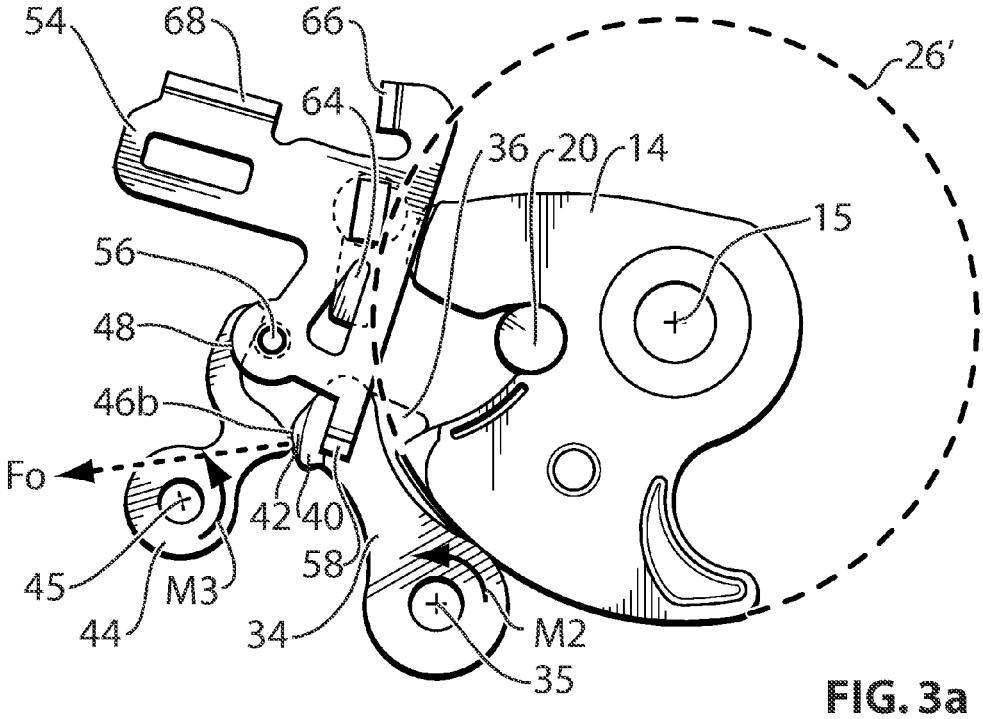
FIG. 3A is a plan view of a portion of the latch shown in FIG. 1 in a partially actuated position.
Figure 3B:
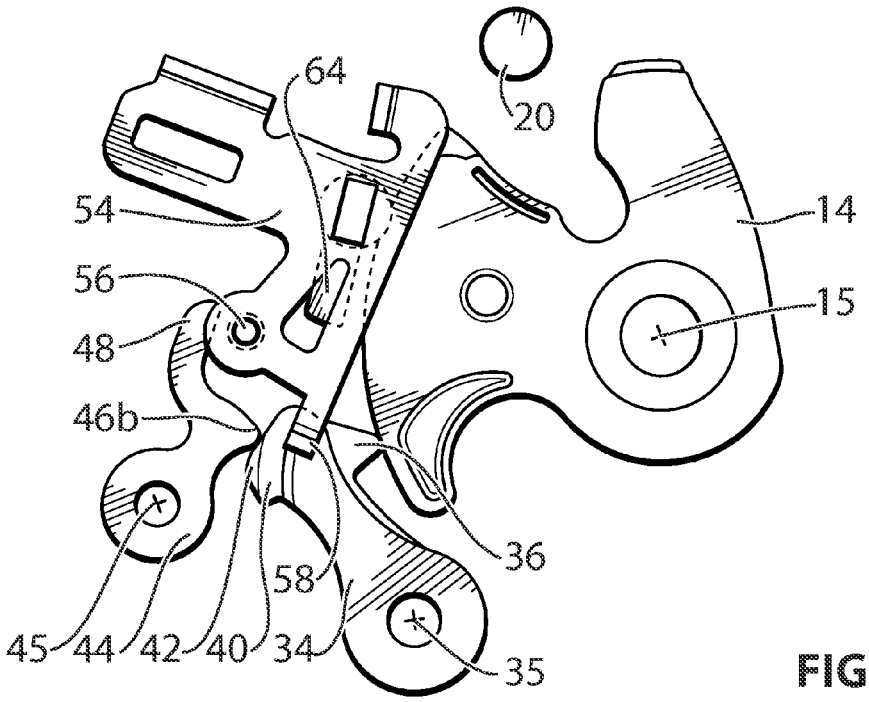
FIG. 3B is a plan view of a portion of the latch shown in FIG. 1 in an open position.

The pawl lever 54 moves between an initial rest position at one end of its travel as shown in FIG. 1 where the pawl lever 54 does not engage or actuate the secondary pawl 44 or the primary pawl 34, and an actuated position, as exemplified in FIG. 3B, in which the pawl lever 54 moves away from its initial position and actuates at least the secondary pawl 44 so as to move the secondary pawl 44 into its primary pawl non-blocking position. The pawl lever 54 and backup pawl 64 are preferably biased to the rest position by a biasing spring or other biasing member (not shown).

The latch preferably also includes an inside handle lever (not shown) which is kinematically coupled to actuate the pawl lever 54 via tab 66. The inside handle lever is kinematically connected to an inside handle (not shown) on the vehicle door via well known mechanisms such as a rod or Bowden cable.

Figure 4A:
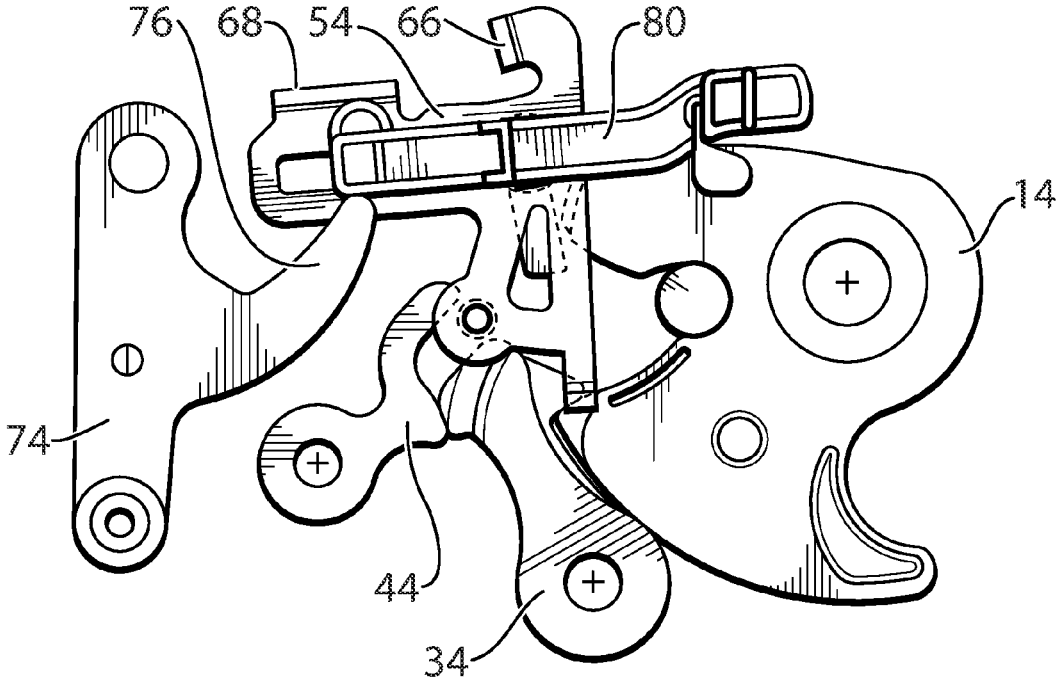
FIG. 4A is a plan view of a portion of the latch shown in FIG. 1 in an outside handle enabled state.
Figure 4B:
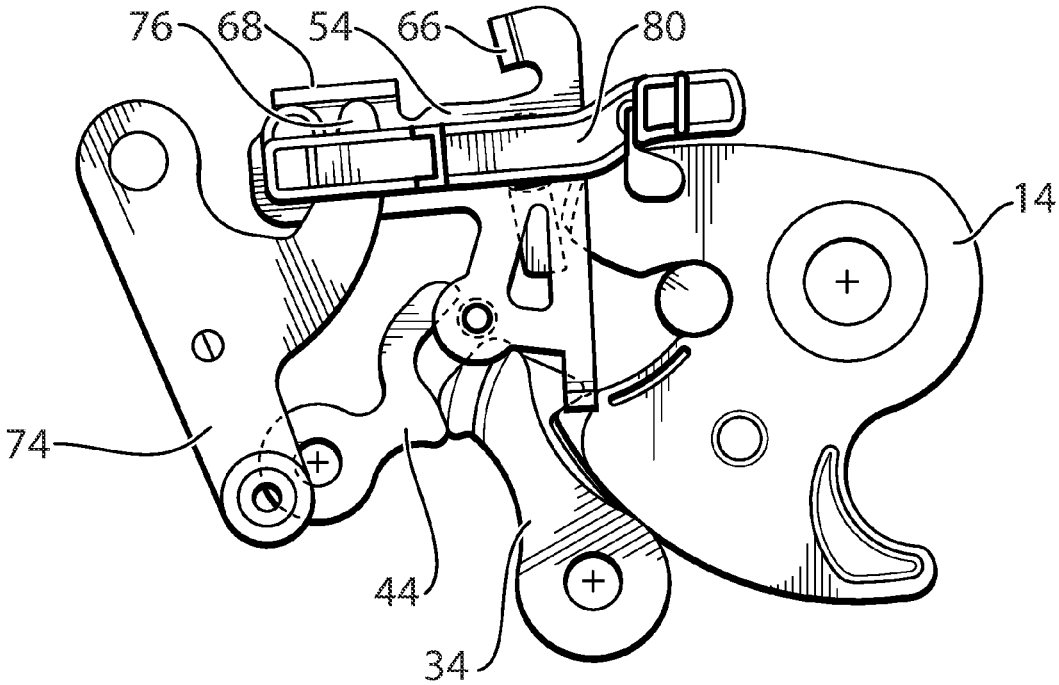
FIG. 4B is a plan view of a portion of the latch shown in FIG. 1 in an outside handle disabled or double lock state.

Similarly, an outside handle lever 74 is pivotally mounted in the housing 12 for rotation about a rotational axis 75. The outside handle lever 74 is kinematically connected to an outside handle (not shown) on the vehicle door via well known mechanisms such as a rod or Bowden cable. A sliding lock link 80 selectively couples or decouples the outside handle lever 74 with the pawl lever 54. More particularly when the lock link 80 is positioned in a coupling position as shown in FIG. 1 or FIG. 4A, arm 76 of the outside lever 74 is coupled to tab 68 of the pawl lever 54 and the outside lever 74 is enabled to actuate the pawl lever 54. However, when the lock link 80 is positioned in a decoupling position as shown in FIG. 4B, the outside lever arm 76 is decoupled from tab 68 and does not have sufficient reach to engage tab 68 thus disabling the outside handle lever from actuating the pawl lever 54.

The sliding lock link 80 may be moved into its coupling or decoupling position by a manual mechanism, such as a mechanical connection with a lock button, or electronically by a small motorized actuator.

As noted above, the ratchet 14 has only a single shoulder or notch 26 for checking the opening urge of the ratchet 14. FIG. 2A shows the ratchet 14 in its full striker capture position, where the notch 26 is engaged by the primary pawl hook shoulder 36. However, as discussed below, the latch requires a low release effort to open it and therefore circumstances could arise especially in the case of a motor vehicle accident or where extraneous forces cause the primary pawl 34 to move out of its ratchet holding position, as shown in FIG. 2A. In this case the pawl lever 54 presents the backup pawl 64 which remains in the rotational path of the ratchet 14 in order to check the opening urge of the ratchet 14 and maintain it in the intermediate striker retaining position, as shown in FIG. 2B. Likewise, on door closing, in the event the vehicle door is closed with a weak force such that the ratchet 14 is not rotated all the way back to its full striker capture position as shown in FIG. 2A, the bias on the pawl lever 54 will urge the backup pawl 64 into the rotational path of the ratchet 14 so that it can be held in the intermediate striker retaining position as shown in FIG. 2B. In this manner ratchet 14 may be reduced in size (in comparison to double notch ratchets) and its single notch utilized to maintain the ratchet in either the full striker capture position or the intermediate striker retaining position.

The opening sequence of the latch, and the low release efforts required to open the latch, may be understood with reference to FIGS. 2A, 3A and 3B.

FIG. 2A shows the latch in its fully closed position when the ratchet 14 in its full striker capture position. In this position there exists a force Fs on the ratchet 14 that is a reaction to the seal force when the vehicle door is closed. The force Fs along with the ratchet bias force presents a moment M1 on the ratchet 14 that is received by the primary pawl 34 at hook shoulder 36 and shown as force Fp. The force Fp will be correlated to the moment M1 and the relative radial distance between the striker 20 and primary pawl/ratchet contact area as measured from the ratchet rotational axis 15. The force Fp is presented eccentric to the primary pawl rotational axis 35 that counteracts the primary pawl bias force to thus present a moment M2 on the primary pawl 34. The primary pawl cam profile 42 and the inter-engaging secondary pawl cam follower profile 46 (at portion 46*a*) are configured to translate the moment M2 into an opening force Fo applied substantially through the secondary pawl rotational axis 45 such that, in the fully closed position, there is substantially no opening moment applied to the secondary pawl 44.

To open the latch, the pawl lever 54 is actuated by either the inside lever or outside lever. As the pawl lever 54 pivots away from its initial position, the depending post 56 interacts with the secondary pawl lever arm 48 and moves the secondary pawl 44 out of its primary pawl blocking position, as shown in FIG. 3A. In this position the primary pawl cam profile 42 engages portion 46*b* of secondary pawl cam follower profile 46, which is configured to apply the force Fo eccentric to the secondary pawl rotation axis 45 causing a moment M3 greater than the opposing moment provided by the secondary pawl biasing force. Consequently, at the position shown in FIG. 3A, a momentum is present whereby the seal force Fs continues to apply moment M2 on the primary pawl 34 which in turn continues to apply moment M3 on the secondary pawl 44 and thus the secondary pawl will continue to rotate away from its primary pawl blocking position without any further input from the pawl lever 54, as shown in FIG. 3B. (Note in FIGS. 3A and 3B the pawl lever depending finger 58 has not yet engaged the primary pawl ridge 40.) At a certain point, as shown in FIG. 3B, the moment M2 moves the primary pawl 34 into its ratchet release position wherein the primary pawl hook shoulder 36 disengages from the ratchet notch 26, enabling the ratchet 14 to move into its striker release position.

It should also be noted that, as seen in FIG. 3A, the initial actuation of the pawl lever 54 causes the backup pawl 64 to move out of the path of the ratchet notch 26, as represented by stippled line 26'. Thus, the mechanism for keeping the ratchet 26 in the intermediate striker retaining portion is withdrawn or disengaged upon opening the latch.

In the event there is an insufficient seal force to drive the "quick release" of the primary pawl 34 and the secondary pawl 44, the pawl lever 54 does incorporate depending finger 58 for engaging ridge 40 of the primary pawl 34 so as to drive the primary pawl 34 into its ratchet release position. However, in normal operation, as discussed above, the momentum provided ultimately by the seal force will cause a quick release of the main and secondary pawls based on a relatively shallow pull of the pawl lever 54.

While the above describes a particular embodiment(s) of the invention, it will be appreciated that modifications and variations may be made to the detailed embodiment(s) described herein without departing from the spirit of the invention.

The invention claimed is:

1. A vehicle latch, comprising:

a ratchet having a single notch, the ratchet movable between a striker release position wherein the ratchet is positioned to receive a striker and a full striker capture position wherein the ratchet is positioned to retain the striker, the ratchet being biased towards the striker release position;

a primary pawl having a shoulder, the primary pawl movable between a ratchet holding position, wherein the shoulder is positioned to engage the notch in order to keep the ratchet in the full striker capture position, and a ratchet release position, wherein the primary pawl permits the movement of the ratchet out of the full striker capture position, the primary pawl being biased towards the ratchet holding position;

a pawl lever and a backup pawl that is rotatable in conjunction with the pawl lever, the pawl lever being movable between an initial position, in which the backup pawl is situated in the path of the ratchet notch so as to hold the ratchet in an intermediate striker retaining position in the event the ratchet moves out of the full striker capture position, and an actuated position, in which the pawl lever initiates the opening of the latch and the backup pawl is withdrawn from the path of ratchet notch, the pawl lever being biased towards the initial position.

2. A vehicle latch according claim 1, wherein the pawl lever is operatively connected to at least one of an inside handle lever and outside handle lever.

3. A vehicle latch according to claim 2, including a sliding lock link for selectively coupling and uncoupling the outside handle lever with the pawl lever.

4. A vehicle latch according to claim 1, including a secondary pawl movable between a primary pawl blocking position, wherein the secondary pawl inhibits movement of the primary pawl from its ratchet holding position, and a primary pawl non-blocking position, wherein the secondary pawl allows movement of the primary pawl into its ratchet release position, the secondary pawl being biased in the primary pawl blocking position; and as the pawl lever moves into its actuated position the pawl lever moves the secondary pawl into its primary pawl non-blocking position to thereby initiate opening of the latch.

5. A vehicle latch according to claim 4, wherein, when the latch is closed and the ratchet is in its full striker capture position, the primary pawl is in its ratchet holding position, and the secondary pawl is in its primary pawl blocking position, a seal force applied to the ratchet is translated to an opening force applied by the primary pawl against the secondary pawl in a direction substantially crossing a rotational axis of the secondary pawl.

6. A vehicle latch according to claim 5, wherein actuation of the pawl lever causes movement of the secondary pawl so as to change the direction of the opening force away from the secondary pawl rotational axis, enabling momentum from the ratchet to drive the primary pawl into the ratchet release position.

7. A vehicle latch according to claim 6, wherein, in the event said momentum is insufficient to move the primary pawl into its ratchet release position, the pawl lever is configured to sequentially actuate the primary pawl into its ratchet release position after the pawl lever actuates the secondary pawl into its primary pawl non-blocking position.

8. A vehicle latch, comprising:

a housing;

a ratchet pivotally mounted in the housing for rotation about a first axis, the ratchet movable between a striker release position wherein the ratchet is positioned to receive a striker and a full striker capture position wherein the ratchet is positioned to retain the striker, the ratchet being biased towards the striker release position;

a primary pawl pivotally mounted in the housing for rotation about a second axis, the primary pawl movable between a ratchet holding position, wherein the primary pawl keeps the ratchet in the full striker capture position, and a ratchet release position, wherein the primary pawl permits the movement of the ratchet out of the full striker capture position, the primary pawl being biased towards the ratchet holding position;

a secondary pawl pivotally mounted in the housing for rotation about a third axis, the secondary pawl movable between a primary pawl blocking position, wherein the secondary pawl inhibits movement of the primary pawl from its ratchet holding position, and a primary pawl non-blocking position, wherein the secondary pawl allows movement of the primary pawl into its ratchet release position, the secondary pawl being biased towards the primary pawl blocking position; and a pawl lever pivotally mounted in the housing for rotation about a fourth axis, the pawl lever having a first portion for engaging the secondary pawl and a second portion for engaging the primary pawl, the pawl lever being movable between an initial position in which the pawl lever does not engage the secondary pawl and primary pawl, and an actuated position, in which the pawl lever actuates at least the secondary pawl, the pawl lever being biased towards the initial position.

9. A vehicle latch according to claim 8, wherein, when the latch is closed and the ratchet is in its full striker capture position, the primary pawl is in its ratchet holding position, and the secondary pawl is in its primary pawl blocking position, a seal force applied to the ratchet is translated to an opening force applied by the primary pawl against the secondary pawl in a direction substantially crossing the third rotational axis.

10. A vehicle latch according to claim 9, wherein actuation of the pawl lever causes movement of the secondary pawl so as to change the direction of the opening force away from the third rotational axis, enabling momentum from the ratchet to drive the primary pawl into the ratchet release position.

11. A vehicle latch according to claim 10, wherein the pawl lever is configured to sequentially actuate the primary pawl via the second portion after actuation of the secondary pawl via the first portion in the event said momentum is insufficient to move the primary pawl into its ratchet release position.

12. A vehicle latch according to claim 8, wherein the pawl lever is operatively connected to at least one of an inside handle lever and outside handle lever.

13. A vehicle latch according to claim 12, including a sliding lock link for selectively coupling and uncoupling the outside handle lever with the pawl lever.

14. A vehicle latch according to claim 8, wherein:

the ratchet has a notch;

the primary pawl has a shoulder that, in the ratchet holding position, is positioned to engage the ratchet notch in order to keep the ratchet in the full striker capture position; and a backup pawl that is rotatable in conjunction with the pawl lever, such that, when the pawl lever is in the initial position the backup pawl is situated in the path of the ratchet notch so as to hold the ratchet in an intermediate striker retaining position in the event the ratchet moves out of the full striker capture position, and when the pawl lever is in the actuated position the backup pawl is withdrawn from the path of ratchet notch so as not to interfere therewith.

15. A vehicle latch, comprising:

a housing:

a ratchet having a notch and being pivotally mounted to the housing for rotation about a first axis between a striker release position and a full striker capture position, wherein the ratchet is operable in its striker release position to receive a striker and is further operable in its full striker capture position to retain the striker, the ratchet being biased toward its striker release position;

a primary pawl having a shoulder and being pivotally mounted to the housing for rotation about a second axis between a ratchet holding position and a ratchet release position, wherein the primary pawl is operable in its ratchet holding position to cause the shoulder to engage the notch for maintaining the ratchet in its full striker capture position and is further operable in its ratchet release position to permit movement of the ratchet out of its full striker capture position, the primary pawl being biased toward its ratchet holding position;

a secondary pawl pivotally mounted to the housing for rotation about a third axis between a primary pawl blocking position and a primary pawl non-blocking position, wherein the secondary pawl is operable in its primary pawl blocking position to inhibit movement of the primary pawl from its ratchet holding position and is further operable in its primary pawl non-blocking position to allow movement of the primary pawl into its ratchet release position, the secondary pawl being biased toward its primary pawl blocking position;

a pawl lever having a first portion engageable with the secondary pawl and a second portion engageable with the primary pawl and being pivotally mounted to the housing for rotation about a fourth axis between an initial position and an actuated position, wherein the pawl lever is operable in its initial position to disengage the secondary pawl and the primary pawl and is further operable in its actuated position to actuate at least the secondary pawl, the pawl lever being biased toward its initial position; and a backup pawl rigidly mounted to the pawl lever for common rotation with the pawl lever about the fourth axis, wherein the backup pawl is located within the path of the notch so as to hold the ratchet in an intermediate striker retaining position when the pawl lever is located in its initial position, and wherein the backup pawl is withdrawn from the path of the notch when the pawl lever is located in its actuated position.

* * * * *